United States Patent [19]

Moyer

[11] 4,134,624

[45] Jan. 16, 1979

[54] FRAMING UNIT FOR A PLURALITY OF RECTANGULAR STRUCTURES

[75] Inventor: Jay B. S. Moyer, Jordan, Canada

[73] Assignee: Moyer Diebel Limited, Jordan Station, Canada

[21] Appl. No.: 901,845

[22] Filed: May 1, 1978

[51] Int. Cl.[2] ..... A47B 97/00

[52] U.S. Cl. ..... 312/204; 312/257 SM; 312/210

[58] Field of Search ..... 312/257 R, 257 SK, 257 SM, 312/257 A, 198, 204, 210

[56] References Cited

U.S. PATENT DOCUMENTS

| | | | |
|---|---|---|---|
| 2,467,377 | 4/1949 | Giegerick et al. | 312/257 SK |
| 2,865,569 | 12/1958 | Levenberg | 312/210 |
| 3,971,605 | 7/1976 | Sasnett | 312/198 |

FOREIGN PATENT DOCUMENTS

| | | | |
|---|---|---|---|
| 1487423 | 7/1967 | France | 312/204 |

*Primary Examiner*—Mervin Stein
*Assistant Examiner*—A. Grosz
*Attorney, Agent, or Firm*—Hirons & Rogers

[57] ABSTRACT

A framing unit is provided for holding together a plurality of rectangular structures placed side by side, such as vending machines, so that they form a monolithic unit. At the same time the unit provides a decorative surround and conceals the fact that the units are not of uniform height. The unit consists of two end panels which are big enough to cover the ends, a top cross member to which the end panels are fastened, an intervening spacer member between each two adjacent structures also fastened to the top cross member, and a depending front member that conceals the top edges and presents a uniform top edge. The front member is hinged to the top cross member so that it can be lifted from the depending position to one in which it is clear of the structure fronts and will not block opening of the front doors of the structures when these reach to the top edges thereof.

6 Claims, 6 Drawing Figures

FIG. 1
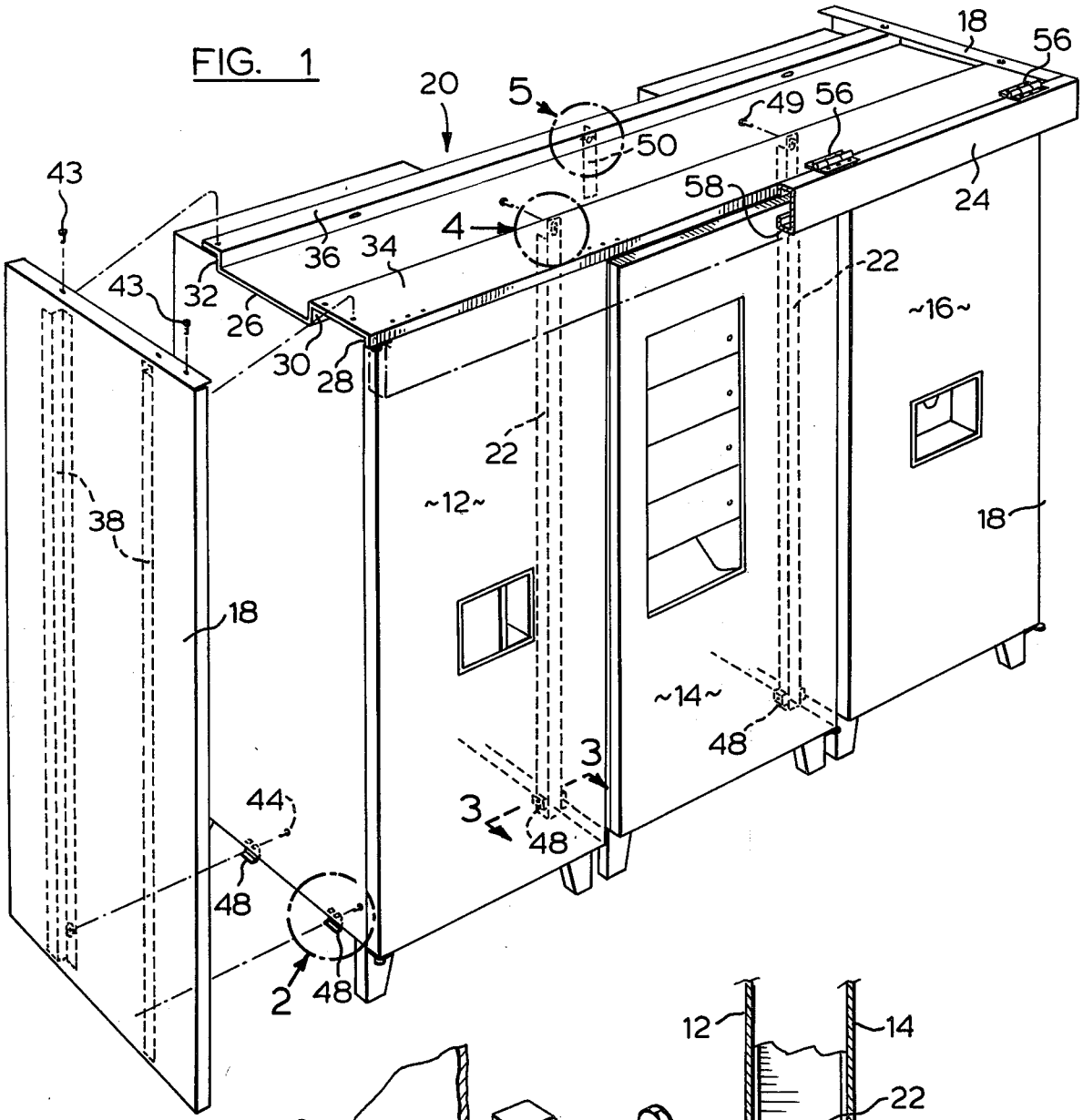
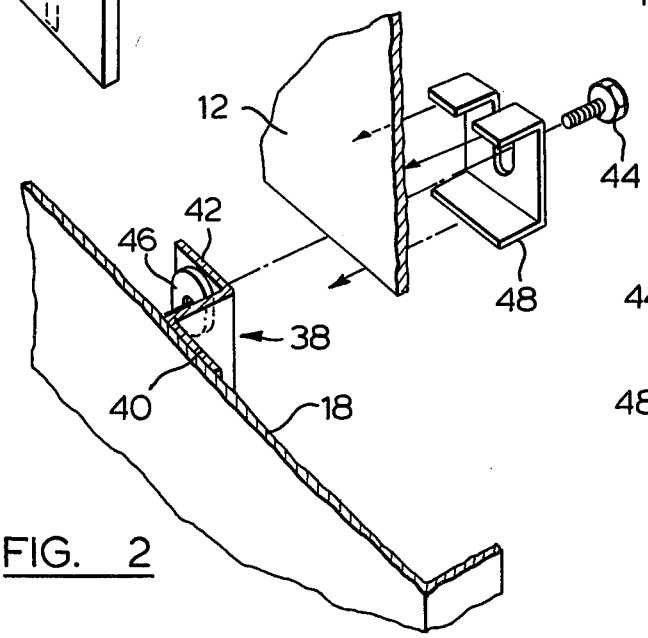
FIG. 2
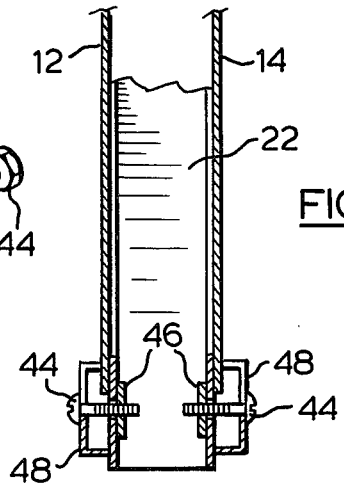
FIG. 3

FRAMING UNIT FOR A PLURALITY OF RECTANGULAR STRUCTURES

FIELD OF THE INVENTION

The present invention is concerned with a framing unit that can be employed with a plurality of rectangular structures placed side by side, such as vending machines, to provide a surrounding frame therefor.

REVIEW OF THE PRIOR ART

It is now commom parctice to provide at a "vending station" location a plurality of vending machines, each vending a different product or group of products, so as to provide a comprehensive, non-attended, cafeteria-type food service. Such machines are now almost universally of rectangular shape, and about the same height, and conveniently are located side-by-side along a wall. However, some small descrepancies in height always exist, and these are emphasized by the need to level each machine on a floor that may itself not be level, so that it is difficult to avoid an uneven appearance. It is usually the desire of the owner of the location to provide as attractive a display as possible, and this could be achieved by the provision of a suitable frame surrounding the machines. Such a frame would also have a practical advantage if it is arranged to mechanically connect the machines together, in reducing the possibility of movement of the individual machines by vandals.

The provision of such a frame involves considerable difficulty if it is to fulfill all of the desired functions, namely to be easily installed, connect the machines rigidly together, provide a decorative appearance, and not interfere with the normal functioning and servicing of the machines.

DEFINITION OF THE INVENTION

It is an object of the present invention to provide a framing unit for use with a plurality of rectangular structures, specifically a plurality of vending machines disposed side by side and closely adjacent to one another.

In accordance with the present invention there is provided a framing unit for a group of a plurality of rectangular structures placed side by side comprising; an end panel member for each end of the group of a size to substantially completely cover the side of the respective end structure, a top cross member of a length to extend the full width of the group and adapted to have the two end panel members fastened to the respective ends thereof, an intervening spacing member for each gap between two immediately adjacent structures adapted to be fastened to the top cross member and to the respective immediately adjacent machines, and a top front member hinged to the front edge of the top cross member and movable on the hinge between a depending position in which it depends in front of the group of structures to shield the top front edges of the structures and provide a uniform height front edge, and another position in which it is above the structure top front edges to permit access thereto.

DESCRIPTION OF THE DRAWINGS

A vending machine framing unit which is a particular preferred embodiment of the invention will now be described, by way of example, with reference to the accompanying diagrammatic drawings, wherein:

FIG. 1 is a general perspective view showing a group of three vending machines with the framing unit mounted in position thereon, parts of the unit being shown exploded or broken away, as necessary, for clarity of illustration, FIG. 2 is an exploded enlarged view of the circular portion indicated by the reference 2 in FIG. 1, FIG. 3 is a partial section to a larger scale taken on the line 3—3 of FIG. 1, FIGS. 4 and 5 are respective exploded enlarged views of the circular portions, indicated by the references 4 and 5 in FIG. 1.

DESCRIPTION OF THE PREFERRED EMBODIMENTS

Figure 4:
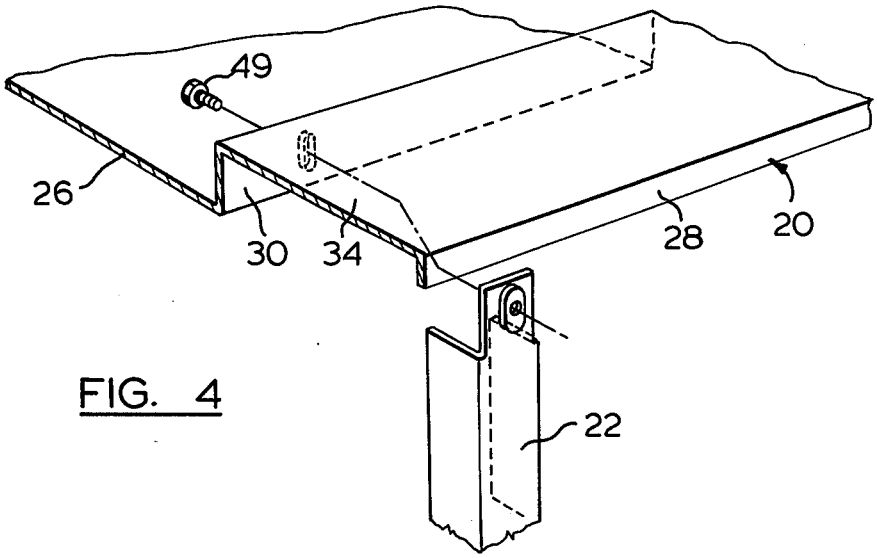

The framing unit illustrated as a particular embodiment of the invention is intended for use with a group of three rectangular-shaped structures 12, 14 and 16 to be framed thereby, each comprising a vending machine, disposed close together side-by-side. Other embodiments of the invention can be employed with two such structures only, or with more than three, and their arrangement will be indicated as the description proceeds. To illustrate the advantages of the invention in more detail the central machine 14 is shown as of shorter length and much less depth than the other two; it will also be assumed that the machines are not necessarily all of the same width. The years of experience in the building of these machines has shown that for simplicity, durability against vandalism, and ease of access to the interior, the door of such a machine should extend over its entire frontal area. The machines are placed in the desired location with their front faces all in the same plane.

A framing unit of the invention consists generally of two hollow end panel members 18 each of a size to substantially completely cover the side of the respective end machine, a top cross member 20 of a length to extend the full width of the assembled group of machines, two spacer members 22 each disposed between two immediately-adjacent machines, and a front member 24 hinged to the top member. The top member is what may be called of inverted top-hat cross section with an additional edge flange, so that it provides a large area horizontal top surface 26 resting on the tops of the machines, three spaced vertical flanges 28, 30 and 32, and two spaced horizontal surfaces 34 and 36 on either side of the surface 26 and vertically spaced therefrom. Each end panel member 18 is formed from a metal sheet by turning the top and side edges at right angles to provide respective flanges, the hollow interior being provided with two Z-section spaced members 38 having one end arm 40 (FIG. 2) fixed to the panel interior surface, while the other end arm 42 will abut the adjacent side wall exterior of the respective end machine. The top ends of the side panel members are fastened to the top member 20 by bolts 43 passing through the panel top edge and the horizontal flanges 34 and 36 of the top member, while the panel bottom ends are fastened to the bottoms of the abutting machines by bolts 44 engaging in nuts 46 on the Z-shaped members and U-shaped clips 48, the bolt-receiving holes in the clips being elongated open-ended slots to provide the necessary vertical adjustment.

Figure 5:
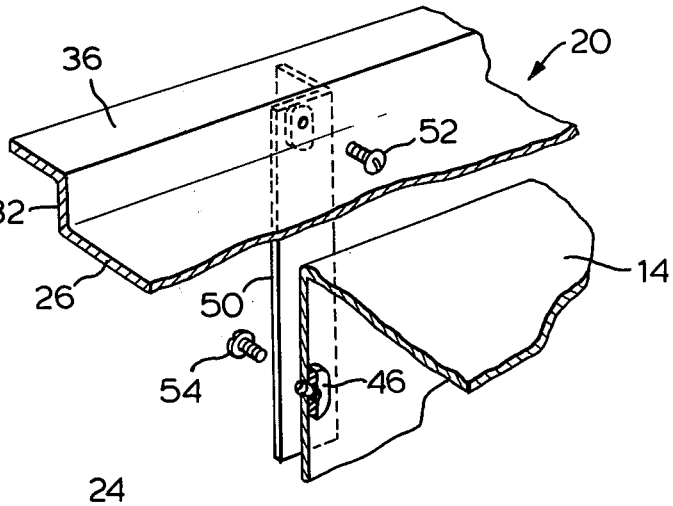

The framing unit also includes the two vertical spacing members 22, which are of U-cross-section, each disposed between two immediately-adjacent machines to space them apart a uniform distance and to maintain them at that spacing. Each member is fastened at its top end by a bolt 49 to the vertical flange 30, and at its bottom end to both of the adjacent machines by bolts 44, nuts 46 and U-shaped clips 48 (FIG. 3). Since the middle machine is shallower than the two side machines, it could during continued use be pushed backwards out of line with the other two machines, and to avoid this it is also fastened to the top member 20 by a depending brace member 50 bolted by bolt 52 to the vertical flange 32 and to the back wall of the middle machine by bolt 54 (FIG. 5). Once the frame has been installed employing a top cross member 20 of appropriate length the three machines are fastened together as a single monolithic unit, and will remain that way during all normal operations.

Figure 6:
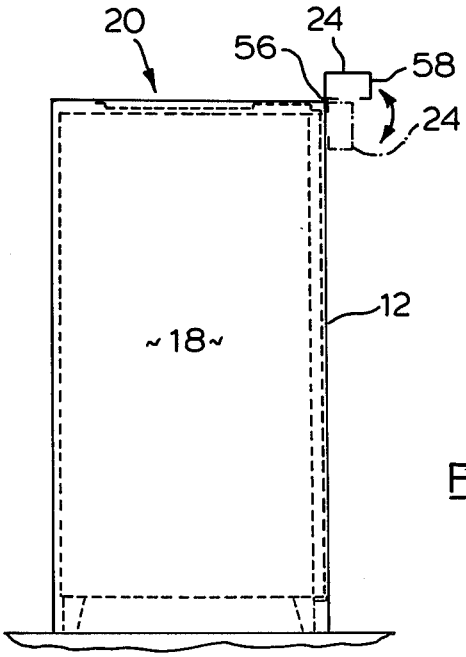
FIG. 6 is a side elevation to illustrate the operation of a top edge member.

An uneven top edge of the assembly unit would detract from the overall appearance, and the decorative front member 24 is therefore made of sufficient height that in the first depending position shown in solid lines in FIG. 6, it will extend below the top edges of all of the machines and provide the desired uniform height top edge. To this end the member is of L-shaped cross-section with one leg hinged by spaced hinges 56 to the top member horizontal surface 34, the other leg forming the depending surface and having a horizontal spacing flange 58 extending therefrom, the flange 58 engaging the aligned front faces of the machines to locate the front member in the said front position. In this position the front member will interfere with the opening of the mechine doors for access and servicing, but when this is required the member can be moved to the position shown in solid lines in FIG. 6, in which it is completely clear of the paths of the doors as they are opened.

We claim:

1. A framing unit for a group of a plurality of rectangular structures placed side by side comprising:

(a) an end panel member for each end of the group of a size to substantially completely cover the side of the respective end structure, (b) a top cross member of a length to extend the full width of the group and adapted to have the two end panel members fastened to the respective ends thereof, (c) an intervening spacing member for each gap between two immediately adjacent structures adapted to be fastened to the top cross member and to the respective immediately adjacent machines, and (d) a top front member hinged to the front edge of the top cross member and movable on the hinge between a depending position in which it depends in front of the group of structures to shield the top front edges of the structures and provide a uniform height front edge, and another position in which it is above the structure top front edges to permit access thereto.

2. A framing unit as claimed in claim 1, wherein the said top cross member is of inverted top hat cross section to provide a central horizontal surface adapted to rest on the structure top, two spaced side horizontal surfaces with the central surface between them, and two spaced vertical surfaces each between the central surface and a respective side surface.

3. A framing unit as claimed in claim 2, wherein each intervening spacing member is adapted to be fastened to the front one of the said two vertical surfaces of the top cross member.

4. A framing unit as claimed in claim 3, wherein a depending brace member for a structure of less depth than the other structures is adapted to be fastened to the rear one of the said two vertical surfaces of the top cross member.

5. A framing unit as claimed in claim 1, wherein each end panel member is of hollow construction with inturned side and top flanges and with two spaced longitudinal Z-section reinforcing members fastened to its interior surface, the panel member top flange being adapted for fastening to the top cross member, while the reinforcing members are adapted for fastening to the adjacent structure bottom edges.

6. A framing unit as claimed in claim 1, wherein the said top front member is of L-shaped cross-section with one arm hinged to the front edge of the top cross member and the other arm when in the said depending position depending in front of the group of structures, the said other arm having a flange thereon that in the depending position engages the structure front faces to locate the depending position of the member.

* * * * *